United States Patent [19]

Sirks

[11] 4,309,008

[45] Jan. 5, 1982

[54] BABY BOTTLE HOLDER

[76] Inventor: Walter M. Sirks, 17450 Mount Herrmann St., Unit F, Fountain Valley, Calif. 92708

[21] Appl. No.: 92,048

[22] Filed: Nov. 7, 1979

[51] Int. Cl.[3] ..... A47D 15/00

[52] U.S. Cl. ..... 248/105; 248/150

[58] Field of Search ..... 248/102, 105, 106, 145.6, 248/150; 215/100 R; D24/48; 294/27 R, 27 H

[56] References Cited

U.S. PATENT DOCUMENTS

| | | | |
|---|---|---|---|
| 2,399,389 | 4/1946 | Riggs | D24/48 X |
| 2,421,458 | 6/1947 | Marino | 248/105 |
| 2,437,133 | 3/1948 | Sirks | 248/106 |
| 2,489,773 | 11/1949 | Hall | 248/105 |
| 2,746,702 | 5/1956 | Gourley | 248/105 |
| 3,512,301 | 5/1970 | Kramer | 215/100 R X |
| 3,718,360 | 2/1973 | Knutzen | 294/31.2 |

*Primary Examiner*—J. Franklin Foss
*Attorney, Agent, or Firm*—Edward E. Roberts

[57] ABSTRACT

A baby feeder having front and rear plate members and a leaf member configured for interconnecting the other two adjacent the midpoint thereof for forming an easel, the front plate member having a pocket in the upper edge thereof configured for receiving a baby bottle. Each of the front and rear plate members and leaf member are provided with apertures aligned and configured for receiving a single strand of an elastic member which is interlaced through the apertures to provide a hingeable connection between the leaf member and the front and rear plate members, the elastic member also forming a harness for retaining a baby bottle in the pocket in a baby feeding position. There is also provided beads at the front and rear of said harness for adjusting tension to accommodate different size lengths and widths of said bottle.

6 Claims, 4 Drawing Figures

BABY BOTTLE HOLDER

BACKGROUND OF THE INVENTION

The background of the invention will be discussed in two parts:

1. Field of the Invention

This invention relates to baby feeders, and more particularly to a baby bottle holder.

2. Description of the Prior Art

In feeding an infant either in a lying position or in a high chair, many infants are incapable of holding the baby bottle, and even those that are capable of holding the bottle have some degree of difficulty in retaining the bottle manually for a length of time sufficient for proper feeding.

Baby bottle holders have been developed for retaining the bottle in an inclined position adjacent the mouth of the infant. Such baby bottle holders are shown and described for example in U.S. Pat. Nos. 1,016,323 (Dixon); 2,349,054 (Phipps); 2,421,458 (Marino); 2,693,334 (Kacprzicki); 2,807,430 (Medlock); 2,909,346 (Jones); and 3,258,235 (Mozley).

Another such baby feeder or baby bottle holder is shown and described in U.S. Pat. No. 2,437,133 issued Mar. 2, 1948 to W. M. Sirks. In the baby feeder of this patent, the baby feeder is in the form of an easel having a front inverted U-shaped member and a rear leg member hingedly coupled along the upper edge. A leaf member is hingedly coupled to the rear surface of the U-shaped member to form a cross leg or interconnecting member with the rear portion of the leaf member having secured thereto two ends of a harness member which extends through apertures in the rear leg member. The upper edge of the U-shaped member has a pocket formed therein for receiving one end of a baby bottle with the harness being configured with a loop for being received over the nipple end of the bottle. While this particular baby feeder enables positioning of a baby bottle adjacent the mouth of an infant, the apparatus requires hinges and a specially configured harness which add to the complexity of manufacturing and the attendant cost of the product.

It is an object of the present invention to provide a new and improved baby feeder for holding a baby bottle.

It is a further object of the present invention to provide a new and improved baby bottle holder composed of few parts for ease of manufacture and assembly.

It is still another object of the present invention to provide a new and improved baby bottle holder having a single strand of elastic material interlaced through the parts for forming a harness for holding the bottle while providing a hingeable interconnection between the parts.

SUMMARY OF THE INVENTION

The foregoing and other objects of the invention are accomplished by providing a baby bottle holder having a front plate member with a pocket portion adjacent the upper end thereof for receiving a baby bottle. A rear plate member and a leaf member are provided for positioning to form an easel. Interconnection of the parts is accomplished by first and second sets of apertures in the leaf member adjacent the front and rear edges with a third set of apertures in the front plate member aligned with the first set of apertures. A fourth set of apertures is provided in the rear plate member for general alignment with the second set of apertures. Other apertures are provided adjacent the upper edges of the front and rear plate members and an elastic member is interlaced through adjacent apertures to secure the assembly and for forming a harness for retaining the baby bottle. The free ends of the elastic member are tied behind the apertures in the rear plate member. Beads are provided for enabling lengthwise adjustment of the harness as well as for adjusting a loop formed in the front end of the harness according to the diameter of the nipple end of the bottle. The unit is collapsible for packaging and storage. Preferably the front, rear and leaf members are formed of injection molded polyethylene plastic.

Other objects, features and advantages of the invention will become apparent from a reading of the specification when taken in conjunction with the drawings in which like referenced numerals refer to like elements in the several views.

DESCRIPTION OF THE PREFERRED EMBODIMENT

Figure 1:
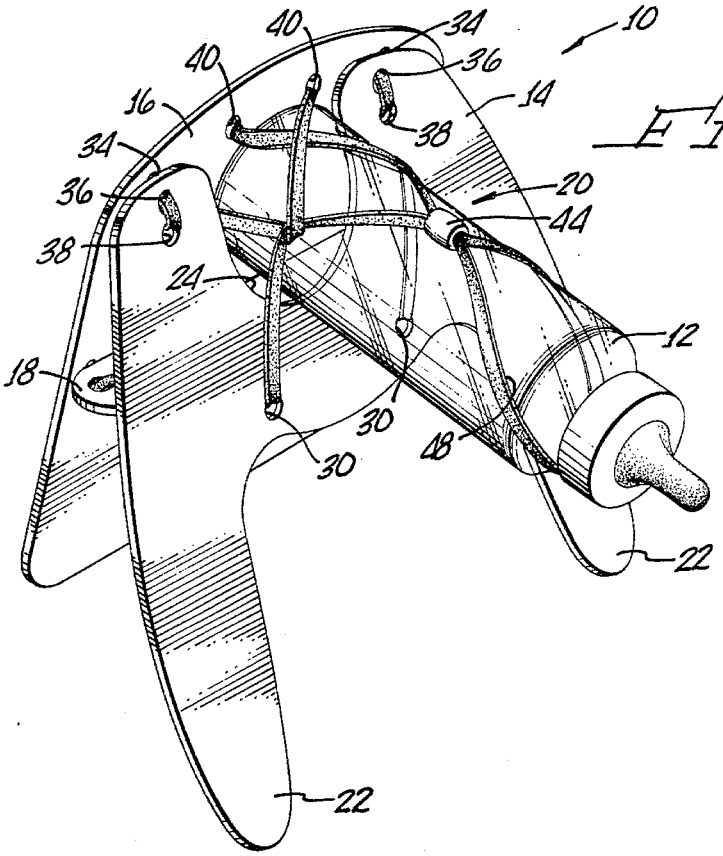
FIG. 1 is a perspective view of the baby bottle holder according to the invention with a baby bottle retained thereby.
Figure 2:
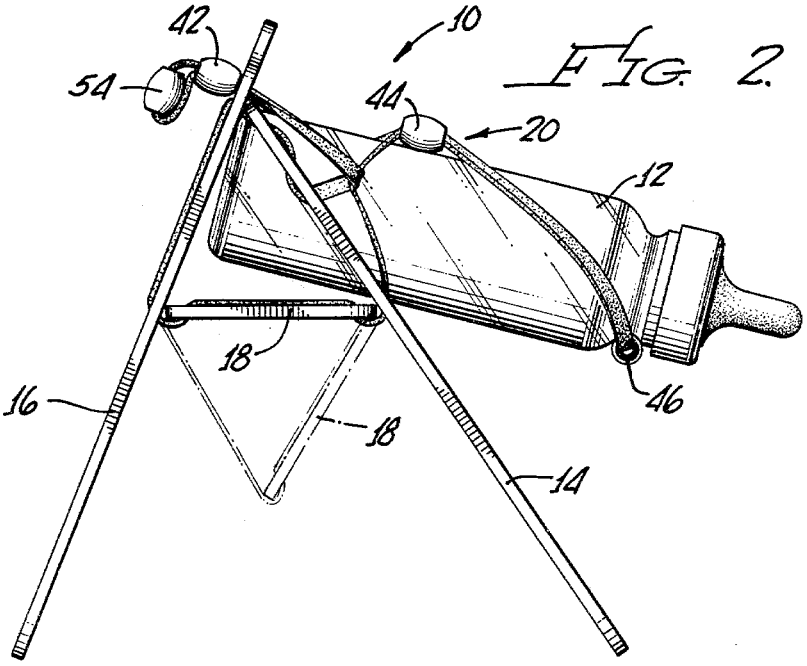
FIG. 2 is a side elevational view of the invention according to FIG. 1.

Referring now to the drawings and particularly to FIGS. 1 and 2 there is shown a baby bottle holder 10 according to the invention retaining a baby bottle 12 in a feeding position for an infant. The baby bottle holder 10 includes a front plate member generally designated 14, a rear plate member generally designated 16, an interconnecting or leaf member generally designated 18, and a harness generally designated 20. Each of the front and rear plate members 14 and 16 may be configured in any convenient fashion and although referred to as plate members, it is to be understood that a plate-like or planar configuration is not necessary for the invention. The terminology is selected for purposes of description rather than limitation. The front plate member 14 is configured to provide a pair of downwardly extending leg portions 22 with the upper edge of member 14 being cut away to form a pocket 24 configured for receiving the rear end or bottom of the bottle 12 as illustrated in FIGS. 1 and 2. Since baby bottles 12 have varying diameters and lengths, the size of the opening or pocket 24 is configured for the maximum diameter 12 to be received therein.

Figure 4:
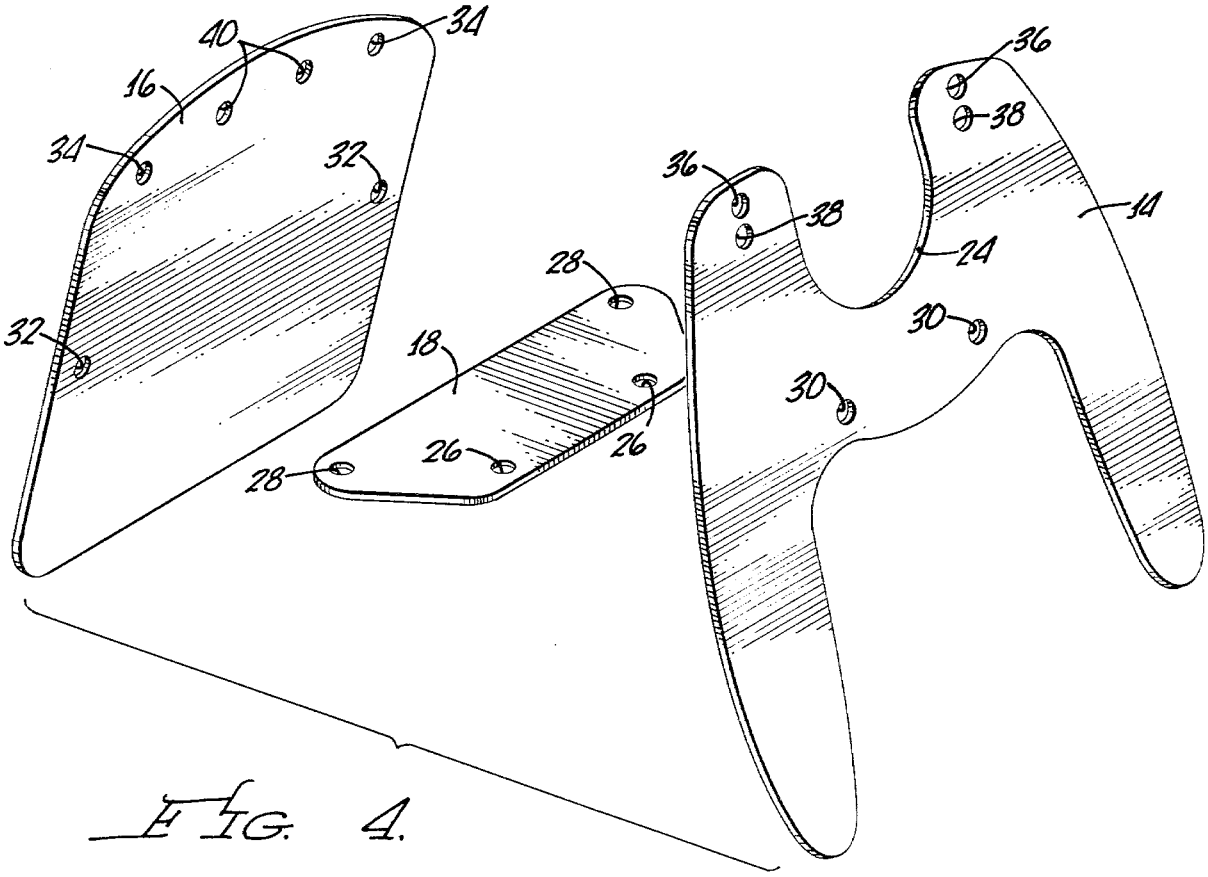
FIG. 4 is an exploded perspective view of the components of the invention of FIG. 1 forming the easel parts.

Viewing also FIG. 4, the rear plate member 16 is provided with a generally rectangular configuration and may likewise be provided with leg depending portions if desired. The leaf member 18 is generally planar and formed as a rectangle or trapezoid with a length generally equal to or slightly smaller than the width of rear plate member 16. As shown in FIG. 2, and in FIG. 4, in the assembled position in side elevation a A-shaped easel is formed with the parts interconnected as will hereinafter be described.

Figure 3:
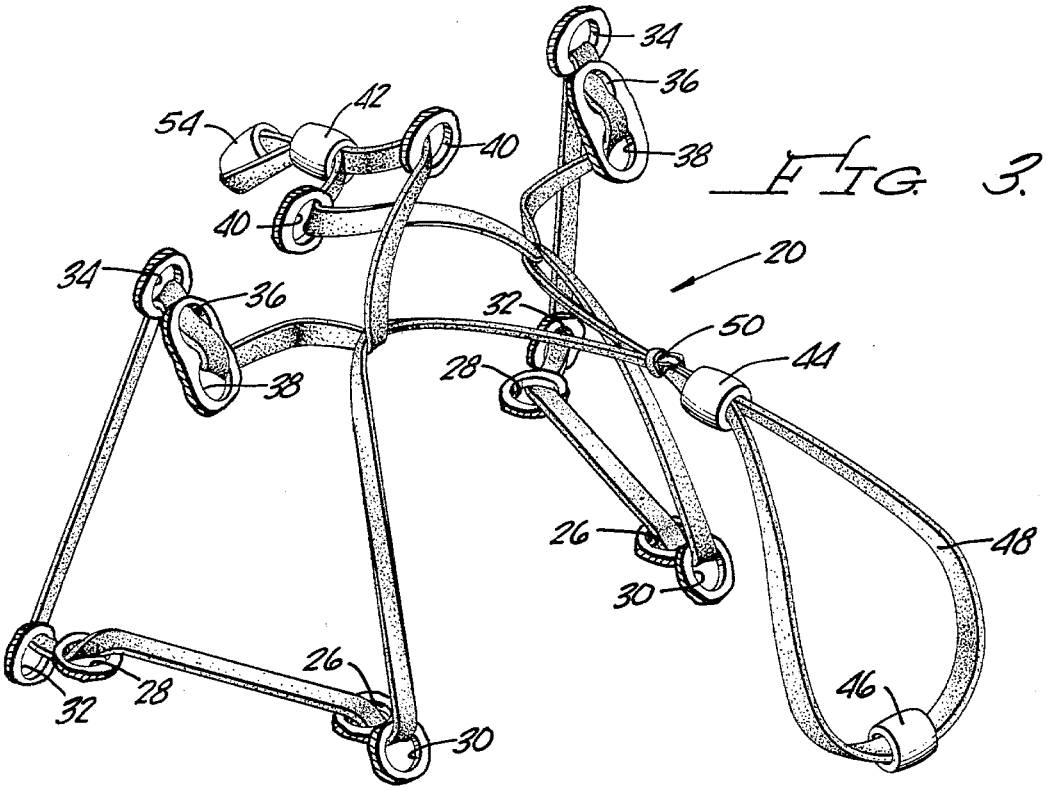
FIG. 3 is a perspective view of the harness used in the invention of FIG. 1 with portions of the parts being illustrated to depict the aperture positions through which the elastic member is interlaced or threaded.

By reference to FIGS. 3 and 4, the forming of the harness 20 and the use of the harness 20 to hingedly interconnect the parts will now be described. The leaf member 18 is provided with a first set of apertures 26 adjacent the front edge thereof and a second set of apertures 28 adjacent the rear edge thereof. The front plate member 14 is provided with a third set of apertures 30 which are positioned in generally horizontal relation and spaced apart for general alignment with the first set of apertures 26. Similarly, the rear plate member 16 is provided with a fourth set of apertures 32 so dimensioned and so positioned for general alignment with the second set of apertures 28 of the leaf member 18. Above the apertures 32 adjacent the upper edge of the rear plate member 16 another pair of apertures 34 are provided for alignment with two pairs of apertures 36 and 38 adjacent the upper edge of the front plate member 14 on opposite sides of the pocket portion 24 thereof.

For manufacturing purposes, the front plate member 14, the rear plate member 16 and interconnecting leaf member 18 are preferably formed in a planar configuration of a polyethylene plastic which may be injection molded in any one of a number of colors for simplicity of manufacture and attractiveness of appearance.

The harness 20 and the use of the harness 20 for hingedly interconnecting the parts will now be described with reference particularly to FIG. 3 as well as FIGS. 1 and 2. In FIG. 3, the majority of the front and rear plate members 14 and 16 as well as the leaf member 18 have been eliminated with only the portions surrounding the apertures being illustrated for ease of description. The harness 20 is formed from a single elastic strand of material which is threaded through the various apertures, tied at appropriate locations, with the elastic member being passed through beads which provide adjustment or act as keepers as will now be described. The apertures in FIG. 3 have reference numerals corresponding to the same aperture in FIG. 4.

Although not necessary, the rear plate member 16 is provided with a closely spaced pair of apertures 40 adjacent the central part of the upper edge thereof which provide the entrance and exit points for threading the elastic member. For purposes of description, since each aperture of a set of apertures has been assigned the same reference numeral, they will be referred to as the left aperture and right aperture of the set respectively according to the left and right hand sides of FIG. 3. Initially, the elastic member is fed through the central aperture of an adjustment bead 42 and thence through the left aperture 40 of rear plate member 16, then through the right aperture 38 to the outer surface of front plate member 14 to pass back through the adjacent right aperture 36. From there the elastic member passes from front to rear through right hand aperture 34 down the back surface of rear plate member 16, thence through aperture 32 and through the aligned aperture 28 along the rear edge of leaf member 18. The elastic member is then threaded through the aligned right apertures 26 and 30 of the leaf member 18 and front plate member 14 respectively. The elastic member is then lapped over itself at the point intermediate left aperture 40 and right aperture 38 and brought forward. The elastic member is then passed through an adjusting bead member 44 and a keeper bead member 46 and then back through the adjusting bead member 44 and tied such as at knot 50 to form a front loop 48 for encircling the nipple end of the bottle 12. The elastic member then loosely threaded through the aligned apertures 30 and 26 of the front plate member 14 and leaf member 18 respectively, thence over the upper surface of leaf member 18 through the rear aligned apertures 28 and 32 of leaf member 18 and rear plate member 16 respectively. The elastic member is then threaded through the aligned apertures 34 of rear plate member 16 and left apertures 36 and 38 in the front plate member 14 adjacent the upper edge thereof. The elastic member is then passed over itself at a point intermediate aperture 30 and knot 50 to then pass through right aperture 40, thence through the adjusting bead 42 thence through a keeper bead 54 whereupon the free ends are tied together and covered by the keeper bead 54. The harness 20 thus formed, by reference to FIGS. 1 and 2 thus supports the baby bottle 12 in the baby feeder or baby bottle holder 10 with the rear of the bottle 12 being urged downwardly by the elasticity of the X-shaped portions of the elastic member passing through the generally centrally located pair of apertures 40 adjacent the upper edge of rear plate member 16. These particular apertures can be eliminated by passing the free ends of the elastic member through the apertures 34 if desired while still providing the X-shaped support as shown. This portion of the elastic member urges the rear or bottom of the bottle 12 downwardly into pocket 24 when the baby bottle holder 10 forms an easel as shown in side elevation FIG. 2. The nipple end of the bottle 12 is receiving through the loop 48, the tension of which may be adjusted by sliding the keeper bead 44 toward or away from the nipple end of the bottle 12. The adjustment of the loop 48 permits the harness 20 to accommodate bottles of varying diameters. Similarly, by reference to FIG. 2, bottles 12 of differing lengths may be accommodated by adjustment of the adjusting bead 42 positioned rearwardly of the rear plate member 16. This adjustment is accomplished by pulling back on the keeper bead 54 to thereby shorten all dimensions of the elastic member forwardly of the front plate member 14. The keeper beads 46 and 54 provide means for retaining the adjusting beads 44 and 42 respectively on the harness 20 and the beads may be differing colors if desired.

In accordance with the invention, with the bottle 12 removed, the elastic member has a large amount of slack which permits movement of the leaf member 18 downwardly as illustrated in dotted lines by the reference numeral 18' in FIG. 2, thus permitting plate members 14 and 16 to be urged toward each other for collapsing the unit for packaging or storage. The harness 20, formed from a single elastic member threaded through aligned apertures and tied at appropriate points provides a harness 20 adjustable lengthwise for varying lengths of bottles with the loop 48 likewise being adjustable to accomodate varying diameters of bottles.

While there has been shown and described a preferred embodiment it is to be understood that various other adaptations and modifications may be made within the spirit and scope of the invention.

What is claimed is:

1. A baby feeder comprising:

a front plate member having a pocket formed in its upper end configured for receiving a baby bottle;

a rear plate member;

an interconnecting member configured for being received between said front and rear plate members generally adjacent the midpoint thereof for forming an easel;

first and second sets of apertures in said leaf member adjacent the front and rear edges respectively;

a third set of apertures in said front plate member for general alignment with said first set of apertures;

a fourth set of apertures in said rear plate member in general alignment with said second set of apertures;

aperture means in said front and rear plate member adjacent the upper edges thereof; and an elastic member interlaced through said first, second, third and fourth set of apertures and said apertures means for providing hingeable interconnection of the parts and configured for receiving and retaining a baby bottle within said pocket.

2. The combination according to claim 1 wherein said elastic member forms a harness including a loop for the nipple end of the bottle.

3. The combination according to claim 2 wherein said harness includes bead means adjacent said loop for adjusting the size of the loop according to the size of the nipple end of the bottle.

4. The combination according to claim 3 wherein said elastic member is a single strand of elastic member with the free ends thereof being tied together behind the aperture means in said rear plate member.

5. The combination according to claim 4 wherein the tied end of said elastic member is provided with other bead means encircling said elastic member for adjusting the length and slack of said harness according to the length of the baby bottle.

6. The combination according to claim 5 wherein said elastic member, said aperture, said plate member and said interconnecting member provide collapsable means for easy packaging and storage of said baby feeder.

* * * * *